US009287633B2

(12) United States Patent
Tseng

(10) Patent No.: US 9,287,633 B2
(45) Date of Patent: Mar. 15, 2016

(54) DUAL FREQUENCY COUPLING FEED ANTENNA AND ADJUSTABLE WAVE BEAM MODULE USING THE ANTENNA

(71) Applicant: Industrial Technology Research Institute, Hsinchu (TW)

(72) Inventor: Wen-Jen Tseng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 598 days.

(21) Appl. No.: 13/674,909

(22) Filed: Nov. 12, 2012

(65) Prior Publication Data

US 2014/0062822 A1 Mar. 6, 2014

(30) Foreign Application Priority Data

Aug. 30, 2012 (TW) ..... 101131577 A

(51) Int. Cl.

| | |
|---|---|
| ***H01Q 21/00*** | (2006.01) |
| ***H01Q 9/16*** | (2006.01) |
| ***H01Q 21/26*** | (2006.01) |
| ***H01Q 9/26*** | (2006.01) |

(52) U.S. Cl.
CPC ..... *H01Q 21/26* (2013.01); *H01Q 9/16* (2013.01); *H01Q 9/26* (2013.01)

(58) Field of Classification Search
CPC ..... H01Q 9/16; H01Q 9/26; H01Q 25/001; H01Q 9/065; H01Q 19/13
USPC ..... 343/816, 797, 798, 834, 833
See application file for complete search history.

(56) References Cited

U.S. PATENT DOCUMENTS

| | | | | |
|---|---|---|---|---|
| 3,845,490 | A * | 10/1974 | Manwarren ..... | H01P 5/1007 333/238 |
| 4,814,777 | A | 3/1989 | Monser | |
| 6,008,773 | A | 12/1999 | Matsuoka et al. | |
| 6,034,649 | A | 3/2000 | Wilson et al. | |

(Continued)

FOREIGN PATENT DOCUMENTS

| | | |
|---|---|---|
| CN | 102437416 | 5/2012 |
| JP | H0537226 | 2/1993 |

(Continued)

OTHER PUBLICATIONS

Zhang et al., "Dual-band and low cross-polarisation printed dipole antenna with L-slot and tapered structure for WLAN applications," Electronics Letters 47(6), Mar. 17, 2011, pp. 360-361.

(Continued)

*Primary Examiner* — Dameon E Levi
*Assistant Examiner* — Ricardo Magallanes
(74) *Attorney, Agent, or Firm* — Jianq Office IP Office

(57) ABSTRACT

A dual frequency coupling feed antenna includes a substrate. There are an upper dipole radiative conductor, a lower dipole radiative conductor, a ground line and a ground reflective conductor disposed on the second surface of the substrate and the two dipole radiative conductors are not electrically connected to each other. The first surface of the substrate has a coupling conductor, a signal line and a feed-matching conductor. The coupling conductor extends parallel to the upper dipole radiative conductor. The ground reflective conductor is located at a side-edge of the dipole radiative conductor and the feed-matching conductor is located on the path of the signal line.

20 Claims, 10 Drawing Sheets

(56) References Cited

U.S. PATENT DOCUMENTS

| | | | | |
|---|---|---|---|---|
| 6,067,053 | A | 5/2000 | Runyon et al. | |
| 6,310,584 | B1 | 10/2001 | Reece et al. | |
| 6,339,404 | B1 | 1/2002 | Johnson et al. | |
| 6,366,258 | B2 | 4/2002 | Reece et al. | |
| 6,529,172 | B2 | 3/2003 | Zimmerman | |
| 6,552,691 | B2 | 4/2003 | Mohuchy et al. | |
| 6,819,300 | B2 | 11/2004 | Gottl | |
| 6,906,678 | B2 | 6/2005 | Chen | |
| 6,937,206 | B2 | 8/2005 | Puente Baliarda et al. | |
| 6,975,278 | B2 | 12/2005 | Song et al. | |
| 7,042,412 | B2 | 5/2006 | Chuang | |
| 7,088,299 | B2 | 8/2006 | Siegler et al. | |
| 7,145,517 | B1 | 12/2006 | Cheng | |
| 7,180,465 | B2 | 2/2007 | Lynch et al. | |
| 7,193,562 | B2 | 3/2007 | Shtrom et al. | |
| 7,218,287 | B2 | 5/2007 | Hung et al. | |
| 7,248,287 | B1 | 7/2007 | Sogawa et al. | |
| 7,358,912 | B1 | 4/2008 | Kish et al. | |
| 7,358,922 | B2 | 4/2008 | Le et al. | |
| 7,362,280 | B2 | 4/2008 | Shtrom et al. | |
| 7,498,996 | B2 | 3/2009 | Shtrom et al. | |
| 7,511,680 | B2 | 3/2009 | Shtrom et al. | |
| 7,612,720 | B2 | 11/2009 | Kerselaers | |
| 7,646,343 | B2 | 1/2010 | Shtrom et al. | |
| 7,652,632 | B2 | 1/2010 | Shtrom | |
| 7,724,201 | B2 | 5/2010 | Nysen et al. | |
| 7,880,683 | B2 | 2/2011 | Shtrom et al. | |
| 7,884,775 | B1 | 2/2011 | Loyet | |
| 7,965,252 | B2 | 6/2011 | Shtrom et al. | |
| 8,031,129 | B2 | 10/2011 | Shtrom et al. | |
| 8,068,068 | B2 | 11/2011 | Kish et al. | |
| 2005/0219121 | A1 | 10/2005 | Chen | |
| 2008/0139136 | A1* | 6/2008 | Shtrom et al. | 455/101 |
| 2009/0207092 | A1* | 8/2009 | Nysen et al. | 343/876 |

FOREIGN PATENT DOCUMENTS

| | | |
|---|---|---|
| TW | 342992 | 10/1998 |
| TW | 382833 | 2/2000 |
| TW | 461596 | 10/2001 |
| TW | 477091 | 2/2002 |
| TW | 503600 | 9/2002 |
| TW | 515132 | 12/2002 |
| TW | 523177 | 3/2003 |
| TW | 553507 | 9/2003 |
| TW | 557607 | 10/2003 |
| TW | 200412745 | 7/2004 |
| TW | M253072 | 12/2004 |
| TW | 200503332 | 1/2005 |
| TW | M274658 | 9/2005 |
| TW | I246225 | 12/2005 |
| TW | M283339 | 12/2005 |
| TW | 200603485 | 1/2006 |
| TW | I252608 | 4/2006 |
| TW | I255584 | 5/2006 |
| TW | I261951 | 9/2006 |
| TW | I264149 | 10/2006 |
| TW | 200711223 | 3/2007 |
| TW | I283945 | 7/2007 |
| TW | I293515 | 2/2008 |
| TW | 200901568 | 1/2009 |
| TW | 200913378 | 3/2009 |
| TW | M354193 | 4/2009 |
| TW | I309899 | 5/2009 |
| TW | 200931724 | 7/2009 |
| TW | M375302 | 3/2010 |
| TW | I323955 | 4/2010 |
| TW | I328312 | 8/2010 |
| TW | M388116 | 9/2010 |
| TW | I1335689 | 1/2011 |
| TW | 201110463 | 3/2011 |
| TW | I338414 | 3/2011 |
| TW | M417671 | 12/2011 |
| TW | I356529 | 1/2012 |
| TW | 201212386 | 3/2012 |
| TW | I360919 | 3/2012 |
| TW | M426892 | 4/2012 |
| TW | 201220603 | 5/2012 |
| WO | 2007070571 | 6/2007 |
| WO | 2012102576 | 8/2012 |

OTHER PUBLICATIONS

Ávila-Navarro et al., "A Low-Cost Compact Uniplanar Quasi-Yagi Printed Antenna," Microwave and Optical Technology Letters 50(3), Mar. 2008, pp. 731-735.

Li et al., "Dual-Band and Wideband Design of a Printed Dipole Antenna Integrated With Dual-Band Balun," Progress in Electromagnetics Research Letters, vol. 6, 2009, pp. 165-174.

Lindberg et al., "Dual wideband printed dipole antenna with integrated balun," IET Microw. Antennas Propag. 1(3), Jan. 2007, pp. 707-711.

Huang et al., "A high-gain dual-band ESPAR antenna with simple on/off controlling," 2010 9th International Symposium on Antennas Propagation and EM Theory (ISAPE), Nov. 29, 2010-Dec. 2, 2010, pp. 315-318.

Wu et al., "Multiband Antennas Comprising Multiple Frame-Printed Dipoles," IEEE Transactions on Antennas and Propagation 57(10), Oct. 2009, pp. 3313-3316.

"Office Action of Taiwan Counterpart Application", issued on Mar. 9, 2015, p. 1-p. 4.

"Office Action of China Counterpart Application," issued on Jun. 19, 2015, p. 1-p. 7.

* cited by examiner

DUAL FREQUENCY COUPLING FEED ANTENNA AND ADJUSTABLE WAVE BEAM MODULE USING THE ANTENNA

CROSS-REFERENCE TO RELATED APPLICATION

This application claims the priority benefit of Taiwan application serial no. 101131577, filed on Aug. 30, 2012. The entirety of the above-mentioned patent application is hereby incorporated by reference herein and made a part of this specification.

BACKGROUND OF THE INVENTION

1. Field of the Invention

The invention relates to an antenna structure and an adjustable wave beam module.

2. Description of Related Art

In recent years, for the development of high-end wireless LAN router (base station), it gradually appears the requirement of switching wave beam of the transceiver antenna so as to fulfill the information transmission with high efficiency. The layout of the transmitting antenna and the receiving antenna mostly adopts a dual-polarized mode of 0°/90°, i.e., horizontal/vertical relatively to the ground, so that the transmitting antenna and the receiving antenna have better isolations to achieve good communication quality.

However, the above-mentioned transmitting and receiving antenna is mostly a dipole architecture, in which for the antenna with horizontal polarization (0°) usually has a smaller coverage range of horizontal radiation so that the transmitting and receiving coverage ranges are not equal to each other.

How to reduce the above-mentioned problem of antenna layout has become an important issue for the industry today.

SUMMARY OF THE INVENTION

Accordingly, an embodiment of the application provides a dual frequency coupling feed antenna, which has a substrate, having a first surface and a second surface opposite to the first surface. There are a first dipole radiative conductor, a second dipole radiative conductor, a ground reflective conductor and a first ground line disposed on the second surface, and there are a signal line, a coupling conductor and a feed-matching conductor disposed on the first surface. The first dipole radiative conductor and the second dipole radiative conductor extend respectively along a forward direction and a backward direction of a predetermined direction. The first dipole radiative conductor and the second dipole radiative conductor further respectively comprise a long-bar portion and a short-bar portion substantially parallel to each other, and the first dipole radiative conductor and the second dipole radiative conductor are not electrically connected to each other. The ground reflective conductor is disposed at a side edge of the first dipole radiative conductor and the second dipole radiative conductor. The first ground line is connected to the ground reflective conductor and the second dipole radiative conductor. In addition, the signal line is for delivering signal. The coupling conductor is coupled to the signal line and disposed to extend parallel to the first dipole radiative conductor for coupling the signal to the first dipole radiative conductor. The feed-matching conductor is disposed on a path where the signal line passes through.

According to another embodiment of the invention, the invention provides a cross-polarization antenna, which includes a receiving dual frequency coupling feed antenna and the transmitting dual frequency coupling feed antenna that are disposed to cross to each other.

According to yet another embodiment of the invention, the invention provides an adjustable wave beam module, which includes a plurality of cross-polarization antennas, a switch module and a control signal unit. Each of the cross-polarization antennas has a transmitting unit and a receiving unit. The switch module is coupled to the above-mentioned cross-polarization antennas for switching the transmitting units in the cross-polarization antennas and the receiving units in the cross-polarization antennas. The control signal unit is coupled to the above-mentioned switch module and a system terminal. The system terminal switches the transmitting units and the receiving units through the control signal unit and the above-mentioned transmitting units and the receiving units can adopt the above-mentioned dual frequency coupling feed antenna.

Based on the above-mentioned exemplary embodiments, the dual frequency coupling feed antenna and the adjustable wave beam module using the antenna can meet the requirement of switching wave beams of the transmitting and receiving antennas to fulfill the information transmission with high efficiency. Accordingly, the exemplary embodiments are able to achieve better isolation, so as to obtain good communication quality. In addition, under the above-mentioned configuration, the coverage range of horizontal radiation is increased to advance the transmitting and receiving coverage ranges.

Several exemplary embodiments accompanied with figures are described in detail below to further describe the disclosure in details.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 8A-8C show an application example of the exemplary embodiment, in which FIG. 8B shows an implementation of the switch module of FIG. 8A and FIG. 8C is a three-dimensional diagram of experimental implementation.

DESCRIPTION OF THE EMBODIMENTS

Figure 1A:
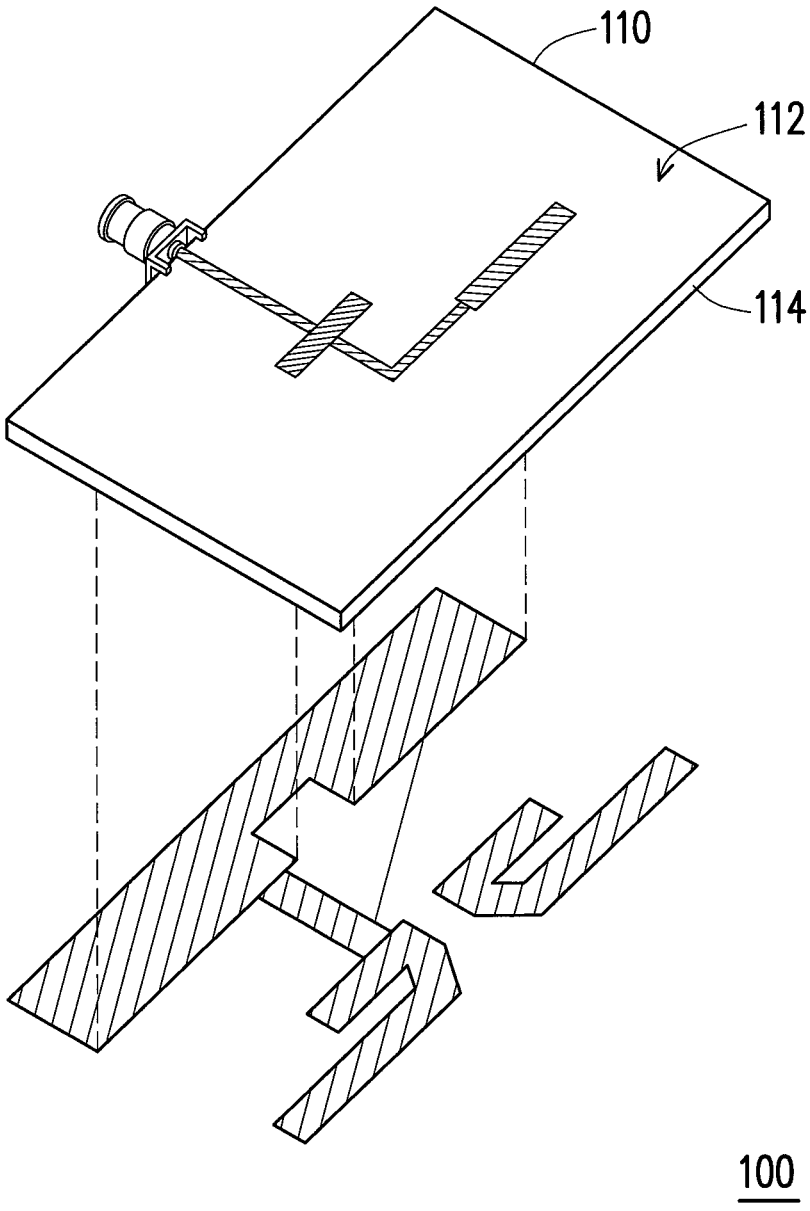
FIG. 1A is a three-dimensional diagram of a dual frequency coupling feed antenna according to an exemplary embodiment.
Figure 1B:
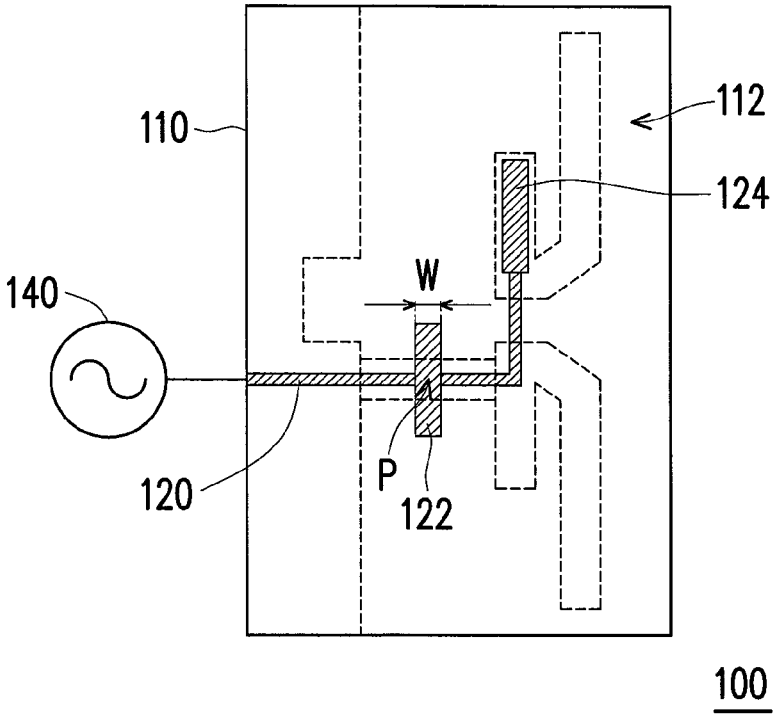
FIG. 1B is a schematic diagram showing the layout of a surface of a substrate in the dual frequency coupling feed antenna of the exemplary embodiment.
Figure 1C:
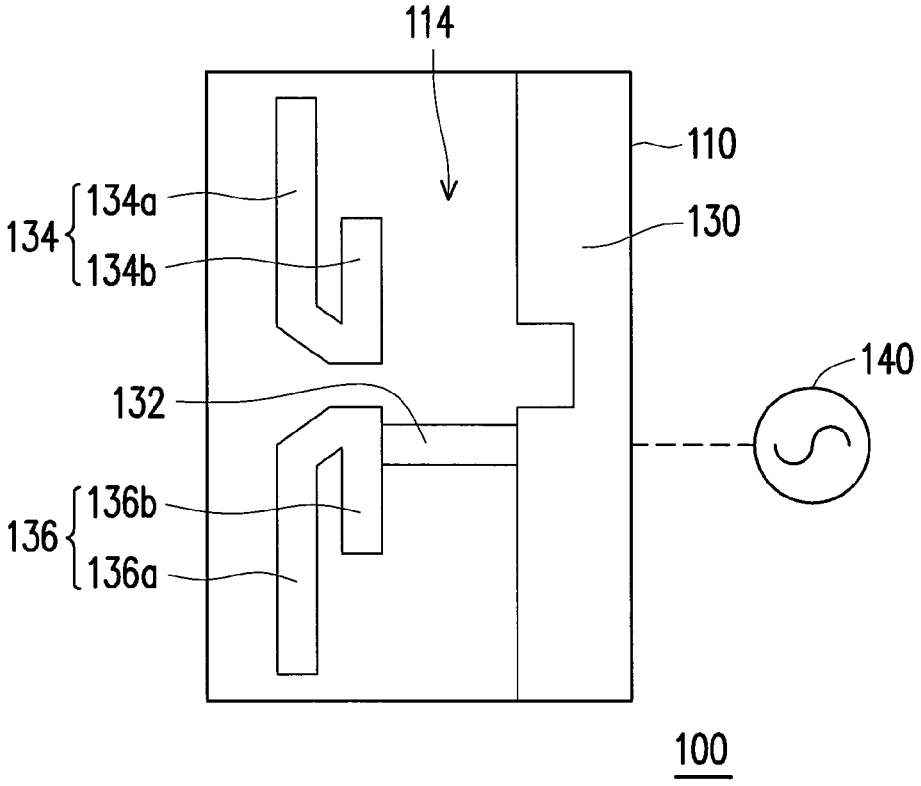
FIG. 1C is a schematic diagram showing the layout of another surface of the substrate in the dual frequency coupling feed antenna of the exemplary embodiment.

FIG. 1A is a three-dimensional diagram of a dual frequency coupling feed antenna according to an exemplary embodiment, FIG. 1B is a schematic diagram showing the layout of a surface of a substrate in the dual frequency coupling feed antenna of the exemplary embodiment and FIG. 1C is a schematic diagram showing the layout of another surface of the substrate in the dual frequency coupling feed antenna of the exemplary embodiment.

Referring to FIG. 1A, a dual frequency coupling feed antenna of the exemplary embodiment disposes an antenna pattern respectively on a first surface 112 and a second surface 114 of a substrate 110, and uses a direct coupling way to transmit and receive the signal. In FIG. 1A, the antenna pattern on the second surface 114 is depicted as a projection, and the real layout would be described in FIGS. 1B and 1C. The antenna of the exemplary embodiment serves as a transmitting unit or a receiving unit, i.e., the antenna serves for transmitting signal or receiving signal.

FIGS. 1B and 1C are schematic diagrams showing the pattern layout on the two surfaces of the substrate in the dual frequency coupling feed antenna of the exemplary embodiment, in which the dotted line in FIG. 1B represents the pattern layout on another surface and, in association with the solid line of FIG. 1C, to make the relative relation between the pattern on the upper surface (the first surface) and the pattern of the lower surface (second surface) understood.

As shown by FIGS. 1B and 1C, the dual frequency coupling feed antenna 100 is built on a substrate 110 and the substrate 110 has a first surface 112 and a second surface 114 opposite to the first surface 112. The opposite property means, for example, the upper and lower two parallel surfaces in the rectangular substrate. The invention does not limit the material of the substrate 110, and in general, any material able to serve as the insulation substrate of a printed circuit board such as plastic and ceramic and so on can be used. People skilled in the art can make a similar material substitute, which is omitted to describe.

As shown by FIG. 1B, there is a signal line 120, a feed-matching conductor 122 and a coupling conductor 124 disposed on the first surface 112. The signal line 120 is connected to a signal source 140, in which the signal source 140 is in charge of transmitting signal for the antenna 100. The signal is delivered to the coupling conductor 124 via the signal line 120 and the feed-matching conductor 122. Then, the signal is coupled to two dipole radiative conductors 134 and 136 located on the second surface 114 through the coupling conductor 124.

The dipole radiative conductors 134 and 136 and the coupling conductor 124 herein are separated by the insulation substrate 110 and the coupling conductor 124 couples the signal to the dipole radiative conductors 134 and 136, followed by radiating the signal through the dipole radiative conductors 134 and 136.

The description above is an example that the antenna serves as the transmitting unit. If the antenna serves as the receiving unit, the signal path is just a reverse direction of the above-mention path. The signal source 140 is replaced by a received signal processing unit.

In FIG. 1B, the feed-matching conductor 122 is disposed on the path of the signal transmission line for fine-tuning the frequency band and the bandwidth. The method of fine-tuning the frequency band and the bandwidth is to change the width W of the feed-matching conductor 122 and the position P on the path of the signal transmission line.

As shown by FIG. 1C, a ground reflective conductor 130, a first dipole radiative conductor 134, a second dipole radiative conductor 136 and a ground line 132 are disposed on the second surface 114. For better understanding, the first dipole radiative conductor 134 and the second dipole radiative conductor 136 are, relatively to the figure plane, respectively referred as an upper dipole radiative conductor 134 and a lower dipole radiative conductor 136. The "upper" and "lower" herein are only for convenience and not to limit the dipole radiative conductors to be "upper" and "lower" layout. In different cases, they can be referred as "left" or "right" layout.

In the exemplary embodiment, the upper dipole radiative conductor 134 and the lower dipole radiative conductor 136 are disposed on the second surface 114 and extend respectively along the forward and the backward directions of a predetermined direction, in which so-called extending directions means the layout directions of the upper dipole radiative conductor 134 and the lower dipole radiative conductor 136 on the substrate 110. In the embodiment, the long side direction of the substrate 110 is taken as an exemplary example of the extending direction. It is certainly, the extending direction can be other one, for example, the short side direction of the substrate. When the substrate is other shapes, the extending direction can be changed accordingly. The above-mentioned forward and backward directions herein mean the extending direction for the upper dipole radiative conductor 134 along the predetermined direction and the extending direction for the lower dipole radiative conductor 136 along the predetermined direction are opposite to each other, which are like to the "+" and "−" directions of a coordinate axis.

In FIG. 1C, the upper dipole radiative conductor 134 further includes a long-bar portion 134*a* and a short-bar portion 134*b* which are in electrical connection and extend towards the same direction. The lower dipole radiative conductor 136 further includes a long-bar portion 136*a* and a short-bar portion 136*b* which are in electrical connection and extend towards the same direction. The long portion and the short portion mean a comparison in lengths thereof.

The above-mentioned upper dipole radiative conductor 134 and the lower dipole radiative conductor 136 are disposed substantially to be symmetric. In addition, the total length of the long-bar portion 134*a* and the long-bar portion 136*a* (long dipoles) of the upper portion and lower portion can be used to control the lower resonant frequency-band, while the total length of the short-bar portion 134*b* and the short-bar portion 136*b* (short dipoles) of the upper portion and lower portion can be used to control the higher resonant frequency-band so as to form a dual frequencies efficiency.

Figure 2A:
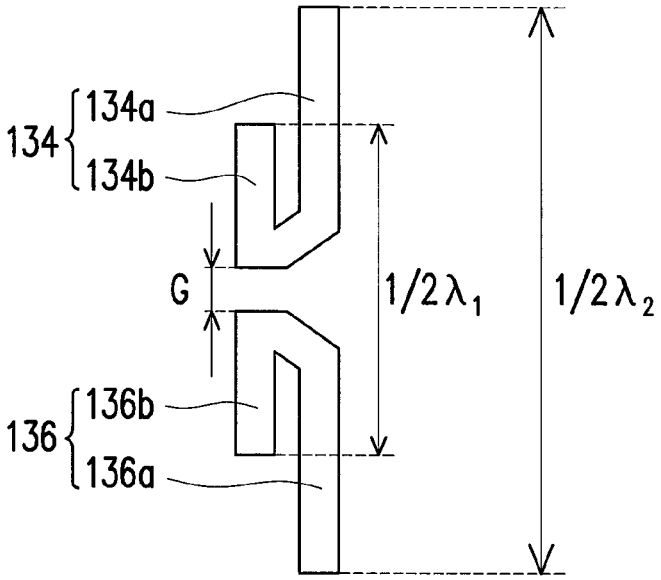
FIGS. 2A-2D show various exemplary patterns of the dipole radiative conductor.

FIG. 2A is a schematic diagram of a dipole radiative conductor where the upper dipole radiative conductor 134 and the lower dipole radiative conductor 136 are not electrically connected to each other and separated by a gap G. The distance of the gap G can be designed according to the application requirement, which the invention is not limited to.

Referring to FIG. 2A, to obtain dipole radiation, usually, the total length between both ends of the long-bar portions 134*a* and 136*a* of the dipole radiative conductors 134 and 136 is substantially a half of the wavelength $\lambda_2/2$ corresponding to the signal frequency to be transmitted and/or received. Similarly, the total length between both ends of the short-bar portions 134*b* and 136*b* of the dipole radiative conductors 134 and 136 is substantially a half of the wavelength $\lambda_1/2$ corresponding to the signal frequency to be transmitted and/or received. The width of the dipole radiative conductors 134 and 136 are decided by the application practice, which the invention is not limited to.

Figure 2B:
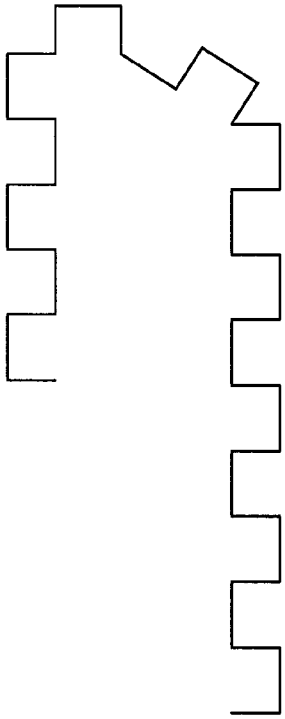
Figure 2C:
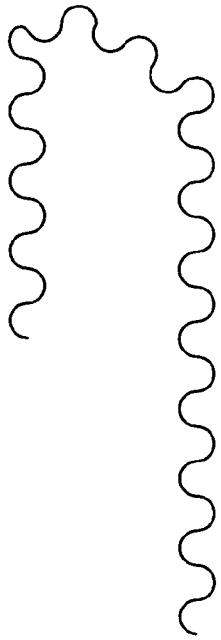
Figure 2D:
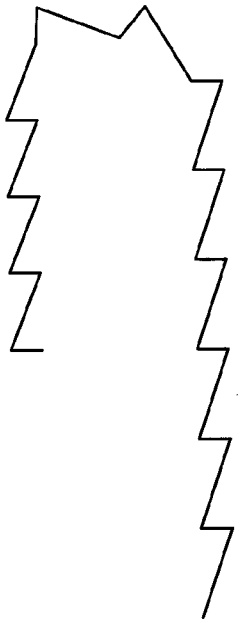

In FIG. 2A, the dipole radiative conductors 134 and 136 are configured in line shape as an exemplary example, however, the shape can be properly modified if the modification does not affect the implementation of the embodiment. For example, it can be a periodic sawtooth pattern as shown in FIG. 2B, a periodic sinusoidal waveform pattern as shown in FIG. 2C, or a periodic ramp-shaped pattern (triangle wave) as shown in FIG. 2D, all of which can be applied in the exemplary example.

The ground reflective conductor 130 on the second surface 114 is disposed at a side-edge of the upper dipole radiative conductor 134 and the lower dipole radiative conductor 136 for reflecting the electromagnetic wave radiated by the dipole radiative conductors 134 and 136, so that the radiation pattern of the dual frequency coupling feed antenna posses directivity. In the exemplary embodiment, the ground reflective conductor 130 is disposed, for example, at a long-side edge of the substrate 110 and extends from a short side to another short side. In addition, the embodiment does not limit the width of the ground reflective conductor 130 and the width can be adjusted and modified by the skilled person in the art according to the substrate size, the application requirement and the signal reflection efficiency.

The ground reflective conductor 130 is coupled to the lower dipole radiative conductor 136 through the ground line 132.

The signal line, the coupling conductor and the feed-matching conductor on the first surface 112 can refer to FIGS. 1A and 1B, in which FIG. 1A shows the three-dimensional layout of the dual frequency coupling feed antenna according to an embodiment of the application and FIG. 1B gives the relations between the conductors on the first surface 112 and the second surface 114.

As shown by FIG. 1B, the signal line 120 is disposed on the first surface 112, and the signal line 120 and the ground line 132 together carry out an effect of high-frequency transmission line to transmit signals. In the exemplary embodiment, the signal line 120 extends from a side edge of the substrate 110 to a predetermined position of the coupling conductor 124. That is to say, an end of the signal line 120 is connected to the coupling conductor 124, and the other end thereof is connected to the signal source 140. The signal line 120 is configured to transmit the signal to the antenna, i.e., the dipole radiative conductor terminal.

The coupling conductor 124 is disposed on the first surface 112 to couple the signal line 120. The coupling conductor 124 is disposed at a position opposite to the first dipole radiative conductor 134 and extends parallel to the first dipole radiative conductor 134 for coupling the signal to the first dipole radiative conductor 134.

The feed-matching conductor 122 is disposed on the first surface 112 and at a position P of the path of the signal line 120. The frequency band and the bandwidth can be fine tuned by using the disposing position P or the width W of the feed-matching conductor 122.

In the aforementioned description, the signal line 120, the feed-matching conductor 122, the coupling conductor 124, the ground reflective conductor 130, the ground line 132 and the first dipole radiative conductor 134 and second dipole radiative conductor 136 are basically made of conductive materials. Anyone skilled in the art can adopt appropriate way or material to implement the material, the manufacture and the connection manner if these implements do not affect carrying out the exemplary example, which the invention is not limited to.

Figure 3:
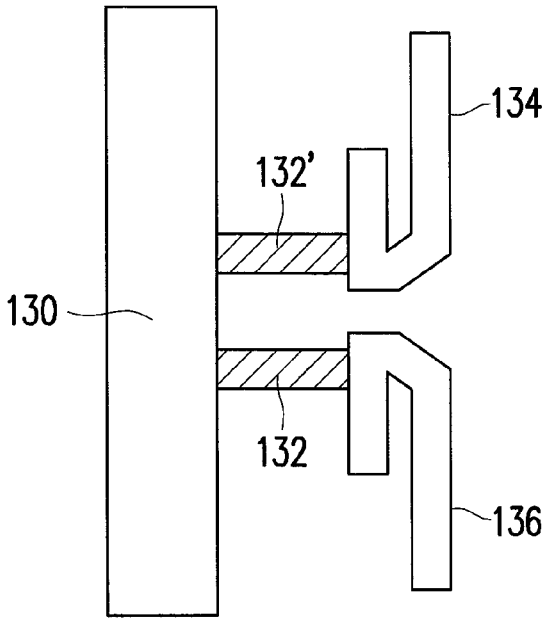
FIG. 3 is another exemplary embodiment corresponding to the layout of FIG. 1C.

FIG. 3 is another exemplary embodiment corresponding to the layout of FIG. 1C. Referring to FIG. 3, in the exemplary example, a second ground line 132' is added and connected to the ground reflective conductor 130 and the upper dipole radiative conductor 134 so that the patterns on the second surface 114 of the substrate 110 appears more symmetrical.

Figure 4:
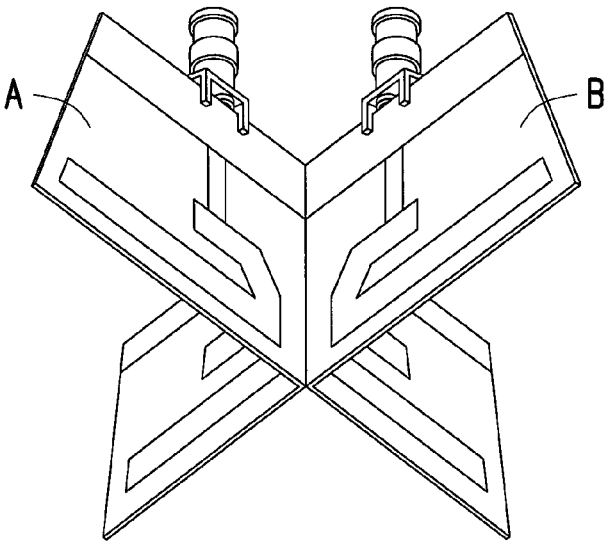
FIG. 4 is an exemplary embodiment showing an X-shaped cross-polarization antenna composed of two dual frequency coupling feed antennas.

FIG. 4 is an exemplary embodiment showing an X-shaped cross-polarization antenna composed of two dual frequency coupling feed antennas. Referring to FIG. 4, the X-shaped cross-polarization antenna comprises two dual frequency coupling feed antennas A and B, which are described above.

In FIG. 4, the two substrates are configured to vertically cross to each other, so as to form a ±45° layout relatively to the ground and thereby have the optimum receiving and transmitting coverage. In the exemplary embodiment, one of the two dual frequency coupling feed antennas A and B serves as a transmitting unit, the other serves as a receiving unit so as to realize a dual frequency transceiver antenna configuration.

Figure 5:
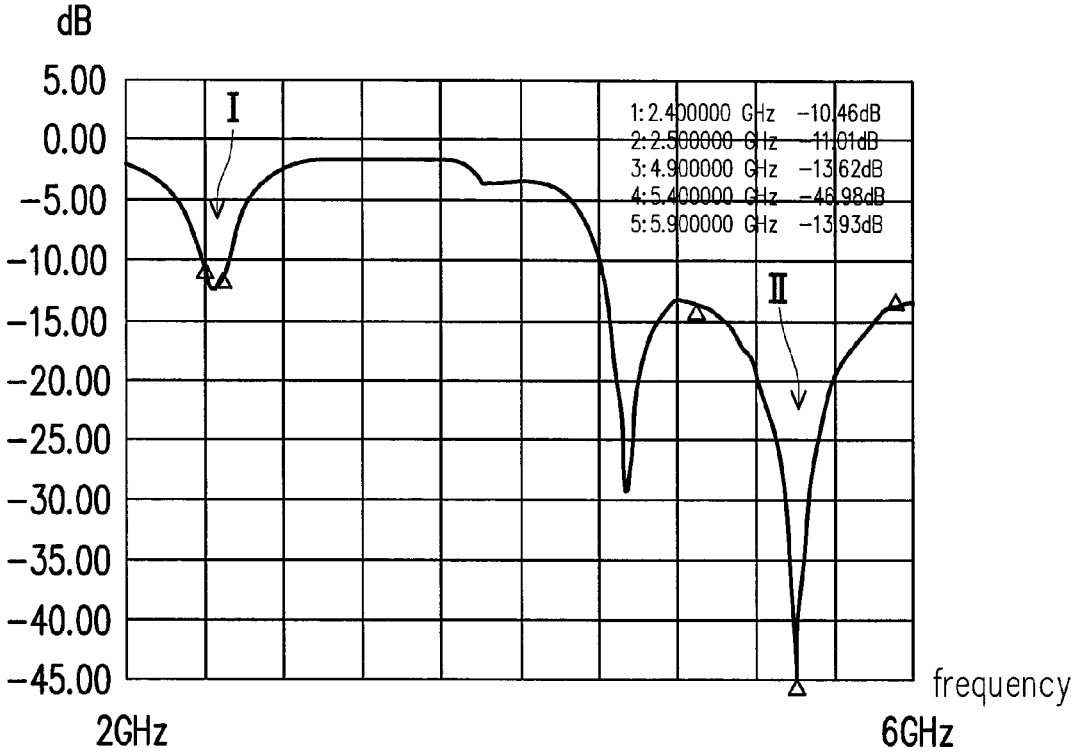
FIG. 5 is a reflection coefficient frequency response graph of the dual frequency coupling feed antenna according to an exemplary embodiment.

FIG. 5 is a reflection coefficient frequency response graph of the dual frequency coupling feed antenna according to an exemplary embodiment. From the graph shown in FIG. 5, it is found that the dual frequency coupling feed antenna of the exemplary example can definitely carry out the dual frequency effect, such as the two bandwidths I and II that are often used.

In addition, the two bandwidths can be adjusted through adjusting the position and width of the above-mentioned feed-matching conductor 122.

Figure 6:
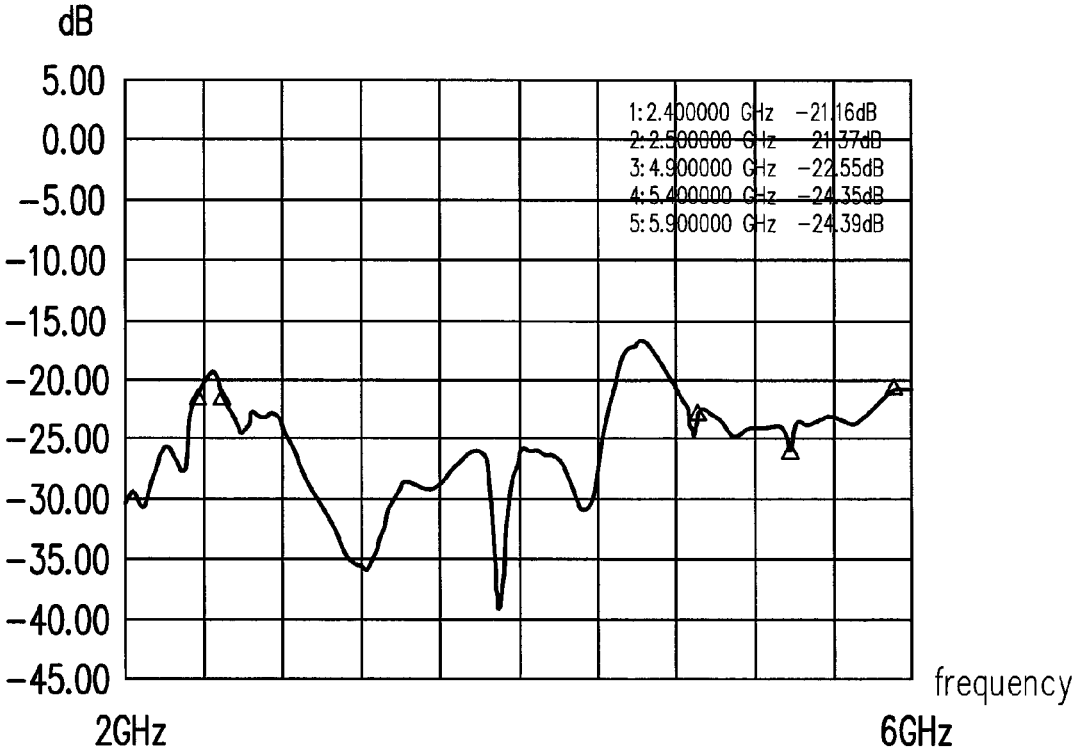
FIG. 6 is a frequency response graph of isolation for the dual frequency coupling feed antenna according to an exemplary embodiment.

FIG. 6 is an isolation-frequency response graph of the dual frequency coupling feed antenna according to an exemplary embodiment. It is found that in FIG. 6, the transmitting antenna and the receiving antenna posses an isolation greater than 19 dB in the above-mentioned two bandwidths. Therefore, the antenna configuration of the embodiment is very good in the isolation.

Figure 7A:
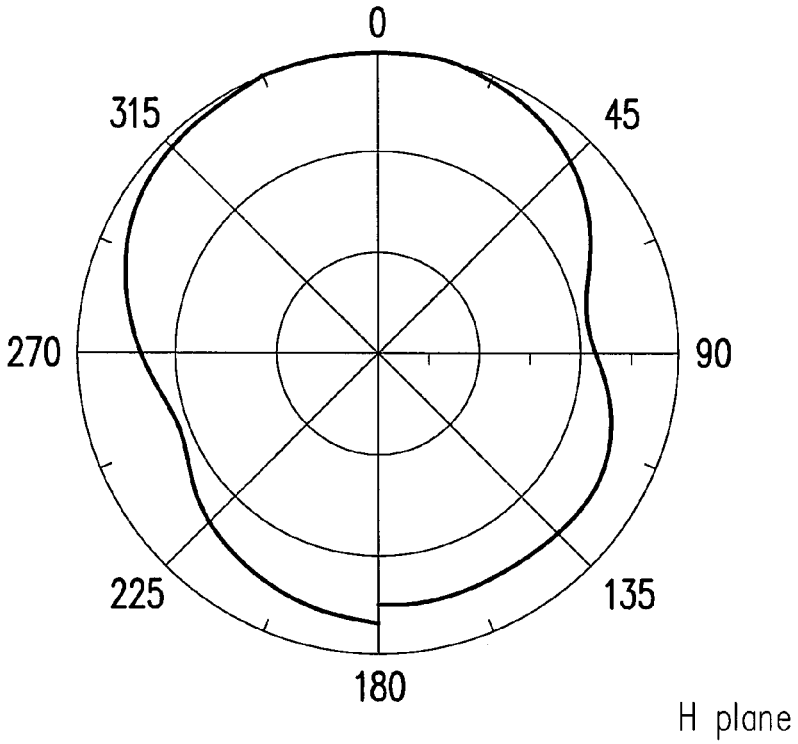
FIGS. 7A and 7B are radiation patterns under the dual frequencies.
Figure 7A:
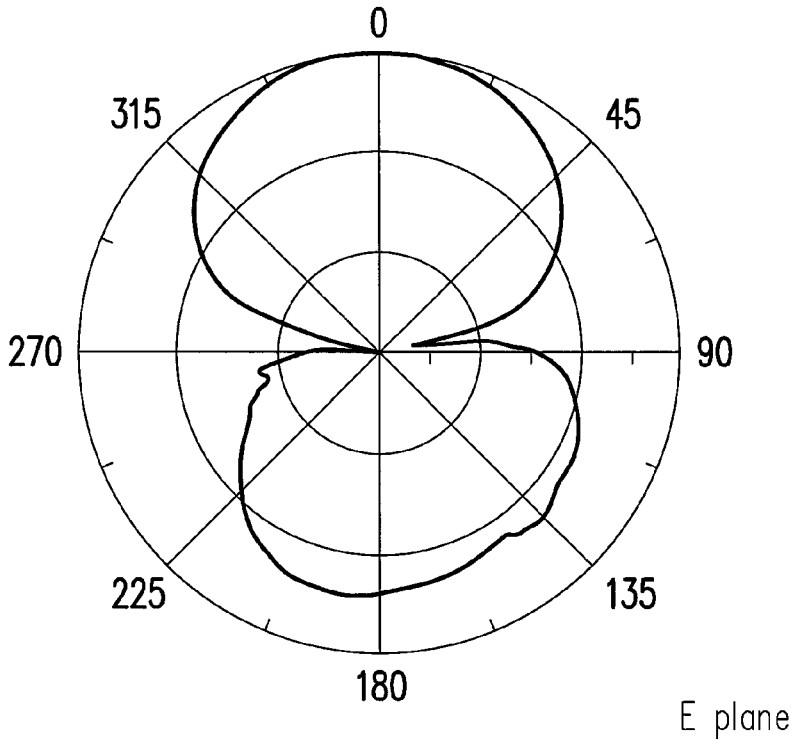
Figure 7B:
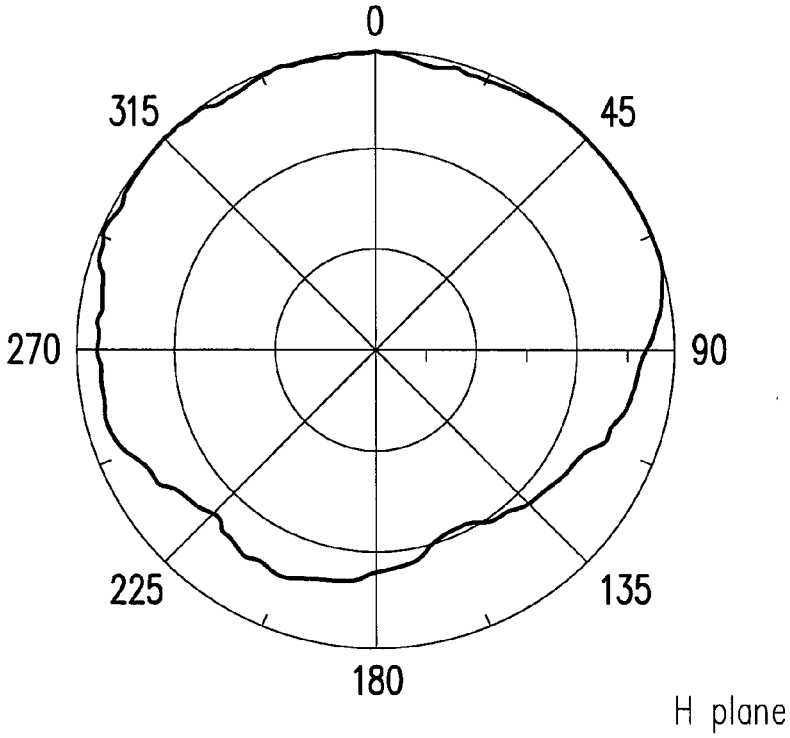
Figure 7B:
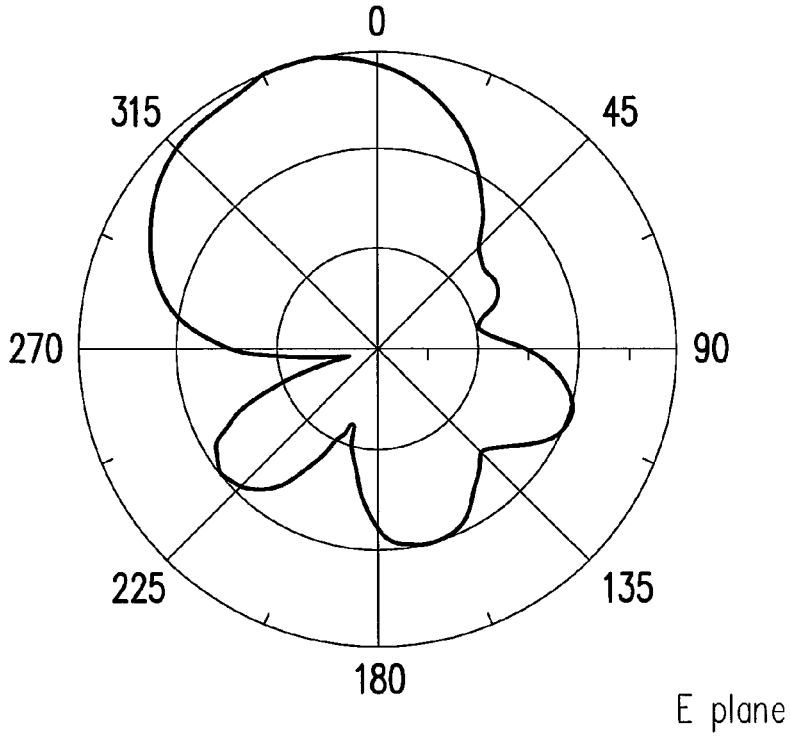

FIGS. 7A and 7B are radiation patterns under the dual frequencies. As shown in FIGS. 7A and 7B, under the configuration of the above-mentioned exemplary example, the radiation patterns of E-plane and H-plane in the two bandwidths are given through experiments. The experiment result proves the configuration provided by the above-mentioned exemplary example can reach an even and larger range field pattern structure.

Figure 8A:
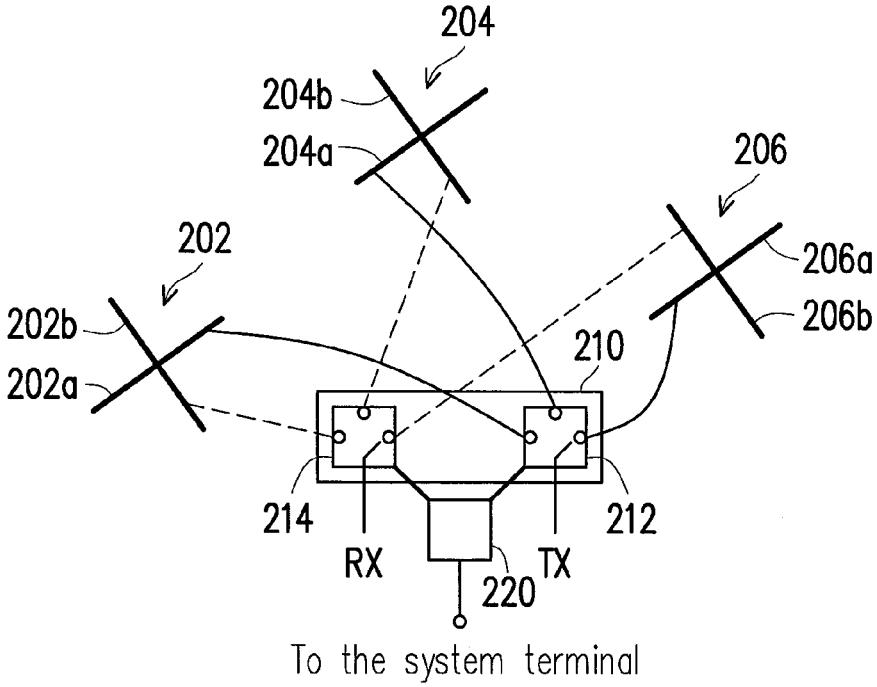
Figure 8B:
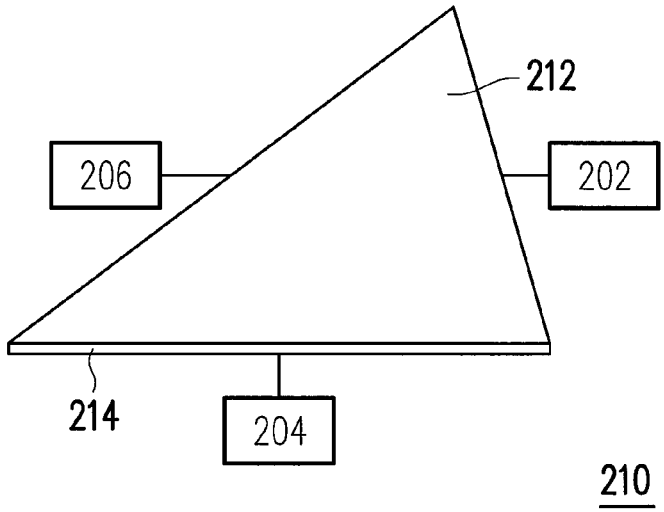
Figure 8C:
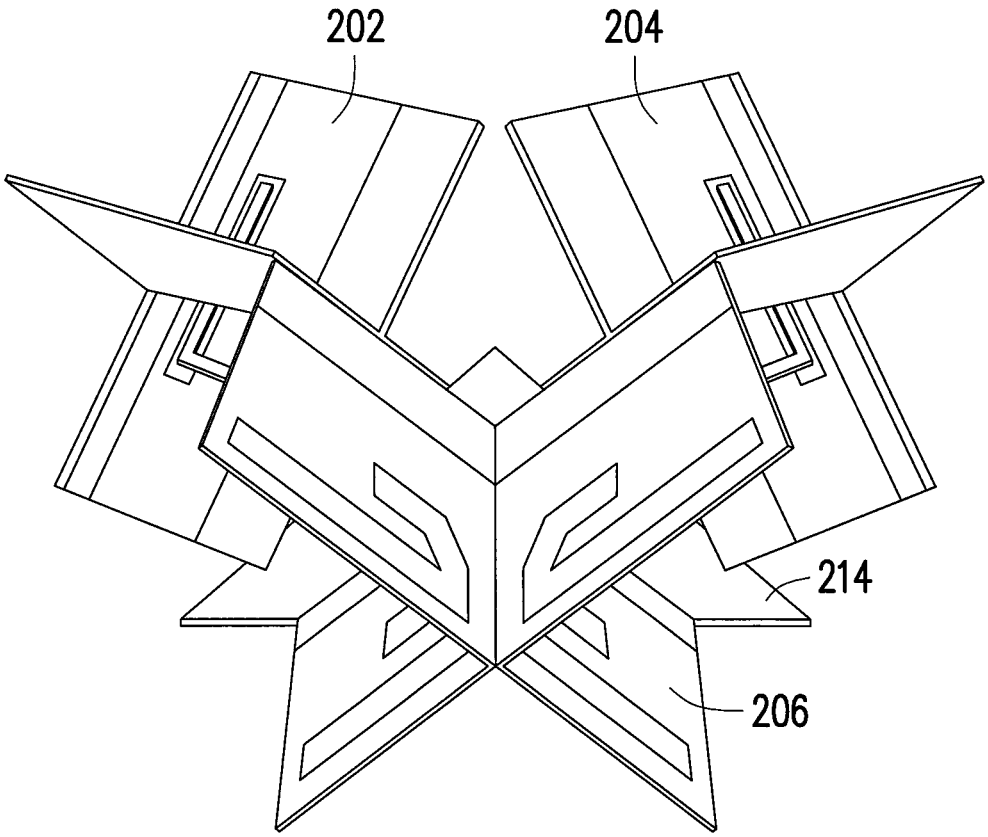

FIGS. 8A-8C show an application example of the exemplary embodiment, in which FIG. 8B shows an implementation of the switch module of FIG. 8A and FIG. 8C is a three-dimensional diagram of experimental implementation.

Referring to FIG. 8A, the adjustable wave beam module herein employs the X-shaped cross-polarization antennas each of which comprises dual frequency coupling feed antennas in the exemplary example of FIG. 4. In the exemplary example, the adjustable wave beam module includes three X-shaped cross-polarization antennas 202, 204 and 206, which respectively have one of three transmitting units 202*a*, 204*a* and 206*a* and one of three receiving units 202*b*, 204*b* and 206*b*. The adjustable wave beam module further includes a switch module 210 and a control signal unit 220.

The switch module 210 includes a first switch 212 and a second switch 214. The first switch 212 has an one-to-three switching path and each the path is electrically and respectively connected to the transmitting units 202*a*, 204*a* and 206*a* of the X-shaped cross-polarization antennas 202, 204 and 206. The second switch 214 has an one-to-three switching path and each the path is electrically and respectively connected to the receiving units 202*b*, 204*b* and 206*b* of the X-shaped cross-polarization antennas 202, 204 and 206.

The transmitting units and the receiving units can be freely switched through the first switch 212 and the second switch 214. For example, when the presently-on-duty transmitting unit 204*a* experiences trouble to fail transmitting the signal, the first switch 212 can switch the path connecting the transmitting unit 204*a* to the transmitting unit 202*a* or 206*a*, so as to adjust the emission position of the wave beam and reduce the transmission obstacle. Similarly, when the presently-on-duty receiving unit 206*b* experiences trouble to fail receiving the signal, the second switch 214 can switch the path connecting the receiving unit 206*b* to the receiving unit 202*b* or 204*b*, so as to adjust the reception position of the wave beam and reduce the reception obstacle.

In addition, a terminal of the control signal unit 220 is coupled to the switch module 210 and the other terminal thereof is coupled to a system terminal. In this way, the system can switch the operating antennas and the coverage area of transmitting/receiving signals according to the demand of efficiency and performance, in which the system terminal conducts control by user switching, automatically setting or software/hardware setting.

FIGS. 8B and 8C show an implementation. As shown by FIGS. 8B and 8C, the above-mentioned switch module 210 is implemented by using, for example, a triangular circuit board. Each of the X-shaped cross-polarization antennas 202, 204 and 206 can be disposed at each side of the circuit board. The switch module 210 includes a substrate, and the first switch 212 and the second switch 214 are respectively formed on the upper and lower surfaces of the substrate. FIG. 8C shows a three-dimensional diagram of the X-shaped cross-polarization antennas 202, 204 and 206 and the switch module 210. Although the switch module is in a triangular substrate shape, but it can be other shape such as rectangular, square, circular or other shapes, which can be selected according to the real demand.

the dual frequency coupling feed antenna and the adjustable wave beam module using the antenna provided by the above-mentioned embodiments can be applied in a high-end wireless LAN router (base station) to meet the requirement of switching the wave beams for the transmitting/receiving antennas, so as to fulfill the information transmission with high efficiency. Meanwhile, the transmitting antenna and the receiving antenna have a better isolation therebetween so as to get good communication quality. In addition, the coverage ranges for the transmission and the reception can be increased.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter.

What is claimed is:

1. A dual frequency coupling feed antenna, comprising:

a substrate, having a first surface and a second surface opposite to the first surface;

a first dipole radiative conductor and a second dipole radiative conductor, disposed on the second surface and extending respectively along a forward direction and a backward direction of a predetermined direction, wherein the first dipole radiative conductor and the second dipole radiative conductor further respectively comprise a long-bar portion and a short-bar portion substantially parallel to each other;

a ground reflective conductor, disposed on the second surface and located at a side-edge of the first dipole radiative conductor and the second dipole radiative conductor;

a first ground line, disposed on the second surface for connecting the ground reflective conductor and the second dipole radiative conductor, wherein the first dipole radiative conductor is electrically floating with respect to the ground reflective conductor;

a signal line, disposed on the first surface for transmitting signal;

a coupling conductor, disposed on the first surface, coupled to the signal line, and extending parallel to the first dipole radiative conductor for coupling the signal to the first dipole radiative conductor, wherein the coupling conductor is not physically connected to the first dipole radiative conductor, wherein the coupling conductor is a bar extending along the forward direction over the first dipole radiative conductor; and a feed-matching conductor, disposed on the first surface and on a path where the signal line passes through.

2. The dual frequency coupling feed antenna as claimed in claim 1, wherein each the long-bar portion and each the short-bar portion of the first dipole radiative conductor and the second dipole radiative conductor are in line-shape.

3. The dual frequency coupling feed antenna as claimed in claim 1, wherein each the long-bar portion and each the short-bar portion of the first dipole radiative conductor and the second dipole radiative conductor are periodic sawtooth pattern, periodic sinusoidal waveform pattern or periodic ramp-shaped pattern.

4. The dual frequency coupling feed antenna as claimed in claim 1, wherein total length between an end of the long-bar portion of the first dipole radiative conductor and an end of the long-bar portion of the second dipole radiative conductor is close to half wavelength of a lower resonant frequency-band, total length between an end of the short-bar portion of the first dipole radiative conductor and an end of the short-bar portion of the second dipole radiative conductor is close to half wavelength of a higher resonant frequency-band.

5. The dual frequency coupling feed antenna as claimed in claim 1, wherein the substrate is an insulation substrate.

6. A cross-polarization antenna, comprising:

a receiving dual frequency coupling feed antenna; and a transmitting dual frequency coupling feed antenna, disposed in cross way to the receiving dual frequency coupling feed antenna, wherein the receiving dual frequency coupling feed antenna and the transmitting dual frequency coupling feed antenna respectively comprise:

a substrate, having a first surface and a second surface opposite to the first surface;

a first dipole radiative conductor and a second dipole radiative conductor, disposed on the second surface and extending respectively along a forward direction and a backward direction of a predetermined direction, wherein the first dipole radiative conductor and the second dipole radiative conductor further respectively comprise a long-bar portion and a short-bar portion substantially parallel to each other;

a ground reflective conductor, disposed on the second surface and located at a side-edge of the first dipole radiative conductor and the second dipole radiative conductor;

a first ground line, disposed on the second surface for connecting the ground reflective conductor and the second dipole radiative conductor, wherein the first dipole radiative conductor is electrically floating with respect to the ground reflective conductor;

a signal line, disposed on the first surface for transmitting signal;

a coupling conductor, disposed on the first surface, coupled to the signal line; and extending parallel to the first dipole radiative conductor for coupling the signal to the first dipole radiative conductor, wherein the coupling conductor is a bar extending along the forward direction over the first dipole radiative conductor; and a feed-matching conductor, disposed on the first surface and on a path where the signal line passes through.

7. The cross-polarization antenna as claimed in claim 6, wherein the receiving dual frequency coupling feed antenna and the transmitting dual frequency coupling feed antenna are disposed in vertical cross way.

8. The cross-polarization antenna as claimed in claim 6, wherein each the long-bar portion and each the short-bar portion of the first dipole radiative conductor and the second dipole radiative conductor are in line-shape.

9. The cross-polarization antenna as claimed in claim 6, wherein each the long-bar portion and each the short-bar portion of the first dipole radiative conductor and the second dipole radiative conductor are periodic sawtooth pattern, periodic sinusoidal waveform pattern or periodic ramp-shaped pattern.

10. The cross-polarization antenna as claimed in claim 6, wherein total length between an end of the long-bar portion of the first dipole radiative conductor and an end of the long-bar portion of the second dipole radiative conductor is close to half wavelength of a lower resonant frequency-band, total length between an end of the short-bar portion of the first dipole radiative conductor and an end of the short-bar portion of the second dipole radiative conductor is close to half wavelength of a higher resonant frequency-band.

11. The cross-polarization antenna as claimed in claim 6, wherein the substrate is an insulation substrate.

12. An adjustable wave beam module, comprising:

a plurality of cross-polarization antennas, wherein each of the cross-polarization antennas has a transmitting unit and a receiving unit;

a switch module, coupled to the cross-polarization antennas for switching the transmitting units in the cross-polarization antennas and the receiving units in the cross-polarization antennas; and a control signal unit, coupled to the switch module and a system terminal, wherein the system terminal switches the transmitting units and the receiving units through the control signal unit, wherein the transmitting units and the receiving units respectively comprise:

a substrate, having a first surface and a second surface opposite to the first surface;

a first dipole radiative conductor and a second dipole radiative conductor, disposed on the second surface and extending respectively along a forward direction and a backward direction of a predetermined direction, wherein the first dipole radiative conductor and the second dipole radiative conductor further respectively comprise a long-bar portion and a short-bar portion substantially parallel to each other;

a ground reflective conductor, disposed on the second surface and located at a side-edge of the first dipole radiative conductor and the second dipole radiative conductor;

a first ground line, disposed on the second surface for connecting the ground reflective conductor and the second dipole radiative conductor, wherein the first dipole radiative conductor is electrically floating with respect to the ground reflective conductor;

a signal line, disposed on the first surface for transmitting signal;

a coupling conductor, disposed on the first surface, coupled to the signal line; and extending parallel to the first dipole radiative conductor for coupling the signal to the first dipole radiative conductor, wherein the coupling conductor is a bar extending along the forward direction over the first dipole radiative conductor; and a feed-matching conductor, disposed on the first surface and on a path where the signal line passes through.

13. The adjustable wave beam module as claimed in claim 12, wherein the switch module further comprises:

a first one-to-multiple switch for switching and selecting one of the transmitting units in the cross-polarization antennas; and a second one-to-multiple switch for switching and selecting one of the receiving units in the cross-polarization antennas.

14. The adjustable wave beam module as claimed in claim 12, wherein each the long-bar portion and each the short-bar portion of the first dipole radiative conductor and the second dipole radiative conductor are in line-shape.

15. The adjustable wave beam module as claimed in claim 12, wherein each the long-bar portion and each the short-bar portion of the first dipole radiative conductor and the second dipole radiative conductor are periodic sawtooth pattern, periodic sinusoidal waveform pattern or periodic ramp-shaped pattern.

16. The adjustable wave beam module as claimed in claim 12, wherein total length between an end of the long-bar portion of the first dipole radiative conductor and an end of the long-bar portion of the second dipole radiative conductor is close to half wavelength of a lower resonant frequency-band, total length between an end of the short-bar portion of the first dipole radiative conductor and an end of the short-bar portion of the second dipole radiative conductor is close to half wavelength of a higher resonant frequency-band.

17. The adjustable wave beam module as claimed in claim 12, wherein the substrate is an insulation substrate.

18. The dual frequency coupling feed antenna as claimed in claim 1, wherein the feed-matching conductor is a rectangular bar crossing the signal line, to fine-tune a frequency band and a bandwidth.

19. The cross-polarization antenna as claimed in claim 6, wherein the feed-matching conductor is a rectangular bar crossing the signal line, to fine-tune a frequency band and a bandwidth.

20. The adjustable wave beam module as claimed in claim 12, wherein the feed-matching conductor is a rectangular bar crossing the signal line, to fine-tune a frequency band and a bandwidth.

* * * * *